US012680491B2

(12) United States Patent
Osci et al.

(10) Patent No.: US 12,680,491 B2
(45) Date of Patent: Jul. 14, 2026

(54) METHOD TO DETERMINE THE OXYGEN STORAGE CAPACITY OF A CATALYTIC CONVERTER OF AN EXHAUST GAS SYSTEM OF AN INTERNAL COMBUSTION ENGINE

(71) Applicant: MARELLI EUROPE S.P.A., Corbetta (IT)

(72) Inventors: Francesco Osci, Corbetta (IT); Umberto Di Martino, Corbetta (IT); Valerio De Rito, Corbetta (IT); Federico Andreoli, Corbetta (IT)

(73) Assignee: MARELLI EUROPE S.P.A., Corbetta (IT)

( * ) Notice: Subject to any disclaimer, the term of this patent is extended or adjusted under 35 U.S.C. 154(b) by 0 days.

(21) Appl. No.: 18/946,654

(22) Filed: Nov. 13, 2024

(65) Prior Publication Data

US 2025/0154891 A1 May 15, 2025

(30) Foreign Application Priority Data

Nov. 14, 2023 (IT) ..... 102023000024141

(51) Int. Cl.
*F01N 11/00* (2006.01)
*F01N 3/20* (2006.01)
*F01N 3/10* (2006.01)

(52) U.S. Cl.
CPC ..... *F01N 11/007* (2013.01); *F01N 3/2033* (2013.01); *F01N 3/105* (2013.01);
(Continued)

(58) Field of Classification Search
CPC ..... F01N 3/105; F01N 3/2033; F01N 11/002; F01N 11/007; F01N 2240/14;
(Continued)

(56) References Cited

U.S. PATENT DOCUMENTS 7,131,320 B2 * 11/2006 Weinowski ..... F01N 11/002 73/23.31
7,162,862 B2 * 1/2007 Nagai ..... F01N 9/005 60/276

(Continued)

FOREIGN PATENT DOCUMENTS

CN 104832305 A * 8/2015
DE 102016124427 A1 6/2017

(Continued)

OTHER PUBLICATIONS

Search Report for Italian Patent Application No. 202300024141 dated May 3, 2024.

*Primary Examiner* — Jesse S Bogue

(74) *Attorney, Agent, or Firm* — Howard & Howard Attorneys PLLC

(57) ABSTRACT

A method to determine the oxygen storage capacity of a catalytic converter of an exhaust gas system of an internal combustion engine is described; wherein the exhaust gas system is provided with an exhaust duct, along which catalytic converter is housed; a lambda sensor housed along exhaust duct downstream of catalytic converter to detect the concentration of oxygen in the exhaust gases; and an exhaust gas after-treatment system having a burner designed to introduce exhaust gases into exhaust duct; wherein inside burner there is defined a combustion chamber, which receives fresh air through a first supply circuit and fuel from a second supply circuit. The method comprises a step in which to recognise that internal combustion engine is in a (Continued)

stop phase or in a slow running mode; a step in which to control the first and the second supply circuit so as to obtain a given objective lambda value, in particular other than one; a step in which to determine a delay with which lambda sensor detects the change in objective lambda value; and a step in which to calculate the oxygen storage capacity of catalytic converter by means of said delay.

9 Claims, 3 Drawing Sheets

(52) U.S. Cl.
CPC ..... *F01N 11/002* (2013.01); *F01N 2240/14* (2013.01); *F01N 2560/025* (2013.01); *F01N 2570/16* (2013.01); *F01N 2900/0422* (2013.01); *F01N 2900/1624* (2013.01)

(58) Field of Classification Search
CPC ..... F01N 2560/025; F01N 2570/16; F01N 2900/0422; F01N 2900/1624; F01N 2550/02; F01N 2610/03; F01N 2610/08; F01N 2900/1402; F01N 2900/1602; F01N 3/30; F01N 3/36; F01N 3/0864; F01N 11/00; F01N 13/00; Y02T 10/40
USPC ..... 60/274, 276, 277, 286, 299, 300, 303, 60/320
See application file for complete search history.

(56) References Cited

U.S. PATENT DOCUMENTS

| | | | | |
|---|---|---|---|---|
| 8,683,856 | B2 | 4/2014 | Kitaura | |
| 8,899,015 | B2 * | 12/2014 | Sato | F02D 41/2454 60/276 |
| 9,650,981 | B1 | 5/2017 | Large et al. | |
| 10,815,861 | B2 * | 10/2020 | Paukner | F01N 3/101 |
| 10,907,519 | B2 * | 2/2021 | Paukner | F01N 3/2006 |
| 11,668,217 | B2 * | 6/2023 | Baron Von Ceumern-Lindenstjerna | F01N 3/101 60/286 |
| 2006/0218893 | A1 * | 10/2006 | Odendall | F02D 41/1439 60/274 |
| 2006/0272315 | A1 * | 12/2006 | Wang | F02D 41/1454 123/694 |
| 2009/0133388 | A1 * | 5/2009 | Watanabe | F01N 3/2053 60/286 |
| 2011/0120095 | A1 * | 5/2011 | Wald | F01N 11/00 60/299 |
| 2011/0183274 | A1 * | 7/2011 | Bahn | F23C 7/008 431/2 |
| 2020/0232364 | A1 | 7/2020 | Ceumern-Lindenstjerna et al. | |

FOREIGN PATENT DOCUMENTS

| | | | | |
|---|---|---|---|---|
| DE | 102019127243 | A1 | 4/2021 | |
| EP | 1936164 | A1 | 6/2008 | |
| JP | 2000027677 | A * | 1/2000 | F01N 13/009 |
| WO | WO-2021069204 | A1 * | 4/2021 | F01N 11/002 |

* cited by examiner

METHOD TO DETERMINE THE OXYGEN STORAGE CAPACITY OF A CATALYTIC CONVERTER OF AN EXHAUST GAS SYSTEM OF AN INTERNAL COMBUSTION ENGINE

CROSS-REFERENCE TO RELATED APPLICATIONS

This patent application claims priority from Italian patent application no. 102023000024141 filed on Nov. 14, 2023, the entire disclosure of which is incorporated herein by reference.

FIELD OF THE ART

The present invention relates to a method for determining the oxygen storage capacity of a catalytic converter of an exhaust gas system of an internal combustion engine.

PRIOR ART

As is well known, an internal combustion engine is typically equipped with a number of cylinders, each of which is connected to an intake manifold and an exhaust manifold, to which an exhaust duct is connected, which feeds the exhaust gases produced by combustion to an exhaust system, which emits the gases produced by combustion into the atmosphere.

An exhaust gas after-treatment system usually comprises a precatalyst arranged along the exhaust duct; a particle filter also arranged along the exhaust duct, downstream of the precatalyst; and a catalytic converter arranged along the exhaust duct, upstream of the particle filter. Finally, the exhaust gas after-treatment system also comprises a burner designed to introduce exhaust gases (and consequently heat) into the exhaust duct in order to speed up the heating of the catalytic converter and facilitate the regeneration of the particulate filter.

Since it is of utmost importance to be able to contain the pollutants produced by the internal combustion engine, it is crucial that the catalytic converter operates correctly. Any faults or malfunctions of the catalytic converter are diagnosed by measuring its oxygen storage capacity (OSC) in order to estimate the conversion efficiency of the exhaust gases passing through the catalytic converter itself.

Typically, the measurement of the oxygen storage capacity is performed by means of a diagnosis strategy in which the development of the objective lambda value of the internal combustion engine is set; during the implementation of the diagnosis strategy, the objective lambda value has a stepwise development in which objective lambda values greater than one and objective lambda values less than one alternate. However, the implementation of this catalytic converter diagnosis strategy results in a significant increase in emissions.

DISCLOSURE OF THE INVENTION

The purpose of the present invention is to provide a method to determine the oxygen storage capacity of a catalytic converter of an exhaust gas system of an internal combustion engine, which is free from the drawbacks described above and, in particular, which is easy and inexpensive to implement.

According to the present invention, a method to determine the oxygen storage capacity of a catalytic converter of an exhaust gas system of an internal combustion engine according to the appended claims is provided.

BRIEF DESCRIPTION OF THE DRAWINGS

The present invention will now be described with reference to the attached drawings, which show a non-limiting embodiment thereof, wherein.

PREFERRED EMBODIMENTS OF THE INVENTION

Figure 1:
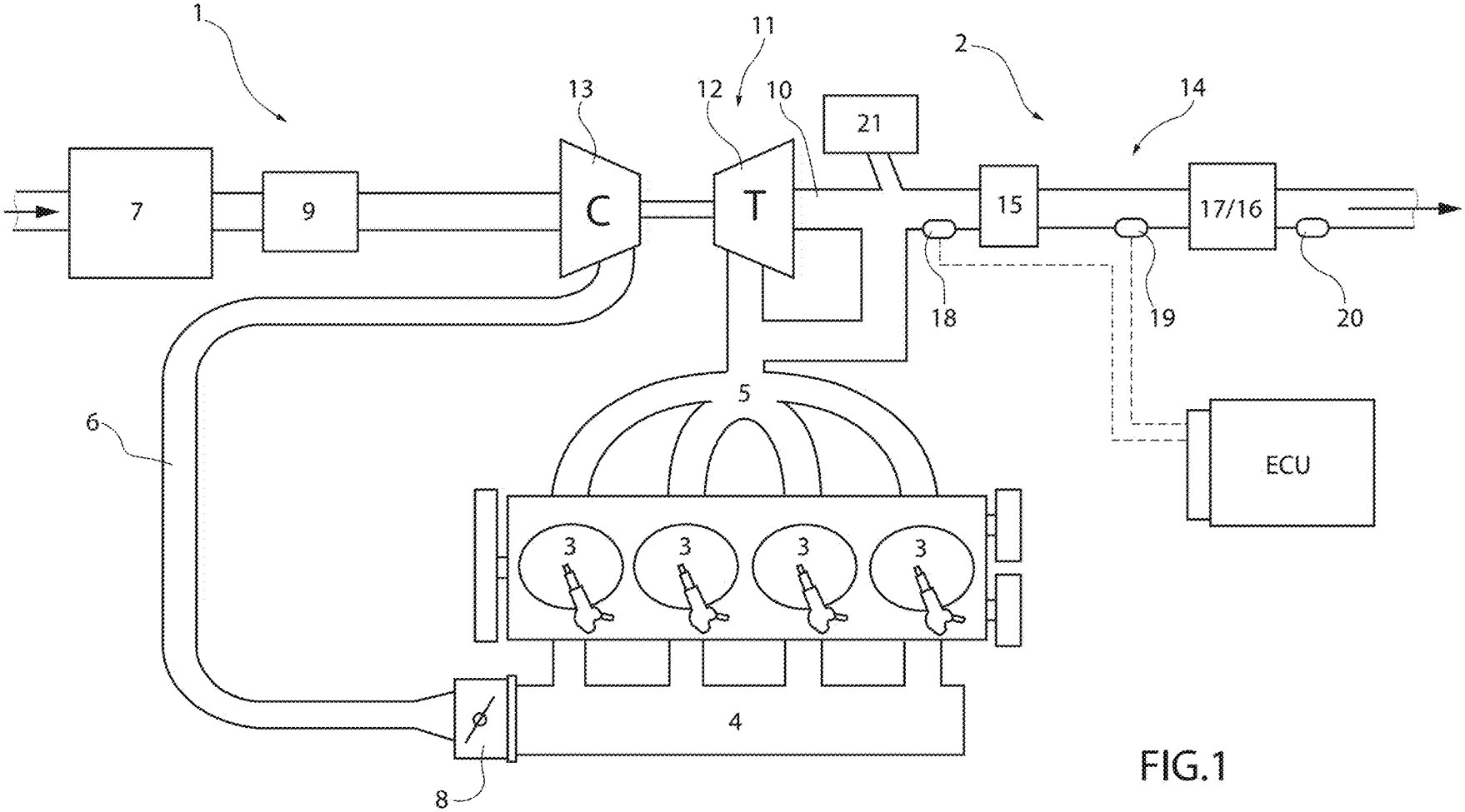
FIG. 1 schematically shows an internal combustion engine equipped with an exhaust gas after-treatment system and an electronic control unit to implement the method covered by the present invention.

In FIG. 1, the number 1 denotes a supercharged internal combustion engine, equipped with an exhaust gas system 2 in a motor vehicle (not illustrated) and having a number of cylinders 3, each of which is connected to an intake manifold 4 and an exhaust manifold 5 via at least one respective exhaust valve (not illustrated).

The intake manifold 4 receives fresh air, i.e. air from the outside environment, via an intake duct 6, which is equipped with an air filter for fresh air flow and is regulated by a throttle valve 8. An air flow meter 9 is also arranged along the intake duct 6 downstream of air filter 7.

An exhaust duct 10 is connected to exhaust manifold 5, which feeds the exhaust gases produced by combustion to exhaust system 2, which emits the gases produced by combustion into the atmosphere.

Supercharged internal combustion engine 1 comprises a supercharged system of internal combustion engine 1, implemented through a turbocharger 11 provided with a turbine 12, which is arranged along exhaust duct 10 to rotate at high speed under the action of the exhaust gases expelled by cylinders 3, and a compressor 13, which is arranged along intake duct 6 and is mechanically connected to turbine 12 to be driven in rotation by turbine 12 itself so as to increase the air pressure present in intake duct 6.

Exhaust system 2 is equipped with an exhaust gas after-treatment system 14 comprising a precatalyst 15 arranged along exhaust duct 10, downstream of turbocharger 11 and a particulate filter 16 (also known as Gasoline Particulate Filter) also arranged along exhaust duct 10, downstream of precatalyst 15. According to a preferred embodiment, exhaust gas after-treatment system 14 is equipped with a catalytic converter 17 arranged along exhaust duct 10 upstream of particulate filter 16. According to a preferred embodiment, catalytic converter 17 and particulate filter 16 are arranged one after the other within a common tubular container.

According to a preferred embodiment, internal combustion engine 1 is further provided with a linear oxygen probe 18 of the UHEGO or UEGO type housed along exhaust duct 10 and interposed between turbocharger 11 and precatalyst 15; with a lambda probe 19 housed along exhaust duct 10 and interposed between precatalyst 15 and the assembly defined by catalytic converter 17 and particulate filter 16 to detect the oxygen concentration within the exhaust gas downstream of precatalyst 15; and finally, a lambda sensor 20 housed along exhaust duct 10 and arranged downstream of the assembly defined by catalytic converter 17 and particulate filter 16 to detect the oxygen concentration within the exhaust gas downstream of the assembly defined by catalytic converter 17 and particulate filter 16.

Exhaust gas after-treatment system 14 then comprises a burner 21 designed to introduce exhaust gases (and thus heat) into exhaust duct 10 in order to speed up the heating of precatalyst 15 and/or catalytic converter 17 and to facilitate the regeneration of particulate filter 16. Burner 21 is arranged so that the exhaust gases are introduced into exhaust duct 10 upstream of precatalyst 15 or upstream of catalytic converter 17.

Figure 2:
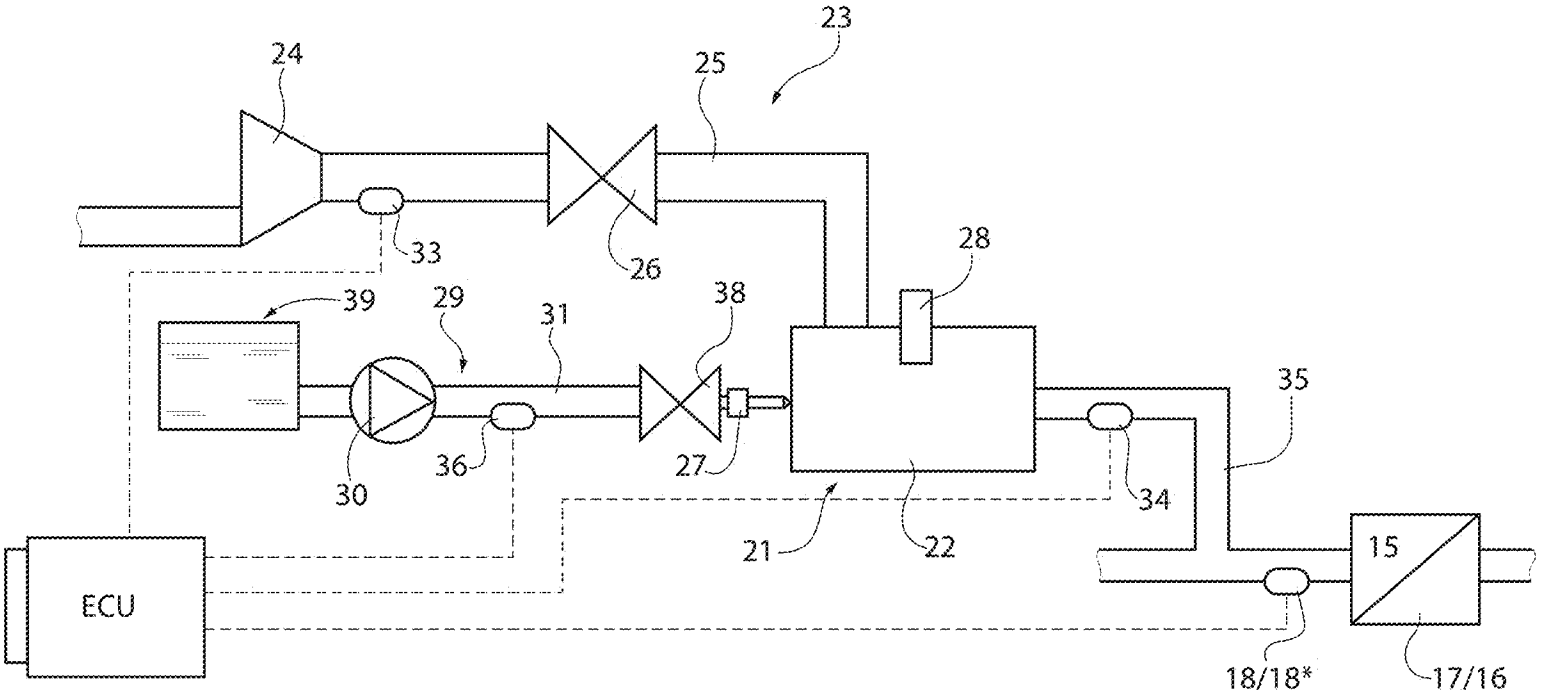
FIG. 2 schematically illustrates the exhaust gas after-treatment system in FIG. 1.

As best illustrated in FIG. 2, a combustion chamber 22 is defined inside burner 21, which receives fresh air (i.e., air from the external environment) via an air supply circuit 23 provided with a pumping device 24 (of a type known and not described in detail), preferably with the interposition of an air filtering element, and supplies air to the burner 21 via a duct 25. According to a first embodiment, pumping device 24 is of the fixed flow type, and a shut-off valve 26 housed along duct 25 (arranged downstream of pumping device 24) is provided to regulate the air flow. Alternatively, pumping device 24 is of the variable flow type (PWM-controlled) and there is a non-return valve 26 housed along duct 25 (arranged downstream of pumping device 24).

Combustion chamber 22 also receives fuel from an injector 27, which is designed to inject fuel into combustion chamber 22. In addition, a spark plug 28 is coupled to burner 21 to determine the ignition of the mixture inside combustion chamber 22. Internal combustion engine 1 then comprises a fuel supply circuit 29 equipped with a pumping device 30 which draws fuel from a tank 39 and feeds it through a duct 31 regulated by a valve 38.

The air-fuel mixture that is fed into combustion chamber 22 is defined as rich in the case of an excess of fuel over the stoichiometric value and is defined as lean in the case of an excess of air over the stoichiometric value. As is conventionally known, lambda $\lambda$ represents the excess air coefficient relative to the air-fuel mixture under stoichiometric conditions. For rich mixtures, lambda $\lambda$ is less than one and for lean mixtures lambda $\lambda$ is greater than one.

Probes 18, 19, 20 are provided to detect/measure the amount of oxygen in the exhaust gas and to provide either a binary on/off output or a linear output, which indicates the oxygen content in the exhaust gas to allow an electronic control unit (usually called "ECU") to calculate the air/fuel ratio of the exhaust gases. In other words, probes 18, 19 and 20 provide an output that indicates whether the detected lambda value $\lambda$ for the exhaust gas is above or below the stoichiometric value (i.e. one).

Finally, internal combustion engine 1 includes a control system, which is designed to oversee the operation of internal combustion engine 1 itself. The control system comprises at least electronic control unit ECU, which oversees the operation of the various components of internal combustion engine 1. It is evident that electronic control unit ECU introduced in the foregoing discussion may be a dedicated electronic control unit ECU overseeing the operation of burner 21 or it may be an electronic control unit ECU overseeing the operation of internal combustion engine 1. Spark plug 28 is driven by electronic control unit ECU to strike a spark between its electrodes and thus ignite the compressed gases inside combustion chamber 22.

Advantageously, electronic control unit ECU is also provided to implement the "Stop and Start" management mode, which provides for shutting down internal combustion engine 1 when the vehicle is stopped or close to a stop typically for traffic-related reasons, such as a red light or an intersection without right-of-way, and provides for restarting internal combustion engine 1 as soon as the user operates the clutch pedal. More generally, "Stop and Start" mode shuts down internal combustion engine 1 even with the vehicle moving at low speed if the driver does not require traction, i.e., releases the accelerator pedal.

Finally, the control system comprises a plurality of sensors connected to electronic control unit ECU. The sensors comprise, in particular, a temperature and pressure sensor 33 of the air flow fed to the burner 21 preferably housed along duct 25 (in other words, sensor 33 is housed along duct 25 downstream of pumping device 24, preferably interposed between pumping device 24 and shut-off valve 26); a temperature and pressure sensor 34 of the exhaust gases exiting burner 21 housed along an outlet duct 35; a pressure sensor 36 of the fuel fed to burner 21 housed along duct 31. Electronic control unit ECU is also connected to UHEGO or UEGO linear oxygen probe 18 and lambda probes 19, 20 from which it receives signals indicative of the air/fuel ratio of the exhaust gases.

The method implemented by electronic control unit ECU to carry out diagnostics on the correct operation of precatalyst 15 is described below. More specifically, the method implemented by electronic control unit ECU to calculate the oxygen storage capacity (OSC) of precatalyst 15 is described below. In order to be able to implement the strategy of calculating the capacity of precatalyst 15 to store oxygen, internal combustion engine 1 must be in a particular operating condition. In particular, electronic control unit ECU is configured to recognise the occurrence of any of the following operating conditions:

- internal combustion engine 1 is switched off after one operating cycle ("after run" condition); or
- internal combustion engine 1 is switched off before starting; or
- internal combustion engine 1 is in a stop phase driven by "Stop and Start" management mode; or
- internal combustion engine 1 is in a standstill phase in hybrid drive vehicles while driving in electric mode; or
- internal combustion engine 1 is running but with a minimal air flow.

In turn, burner 21 may be ignited during the stop phases of internal combustion engine 1 (to heat precatalyst 15 or to calculate the capacity of precatalyst 15 to store oxygen); more specifically, burner 21 may be ignited during the shutdown phases of internal combustion engine 1 driven by "Stop and Start" management mode, during the "after run" phases after an operating cycle, during the "pre-run" phase, or during the electric mode run phases in hybrid drive vehicles.

Figure 3:
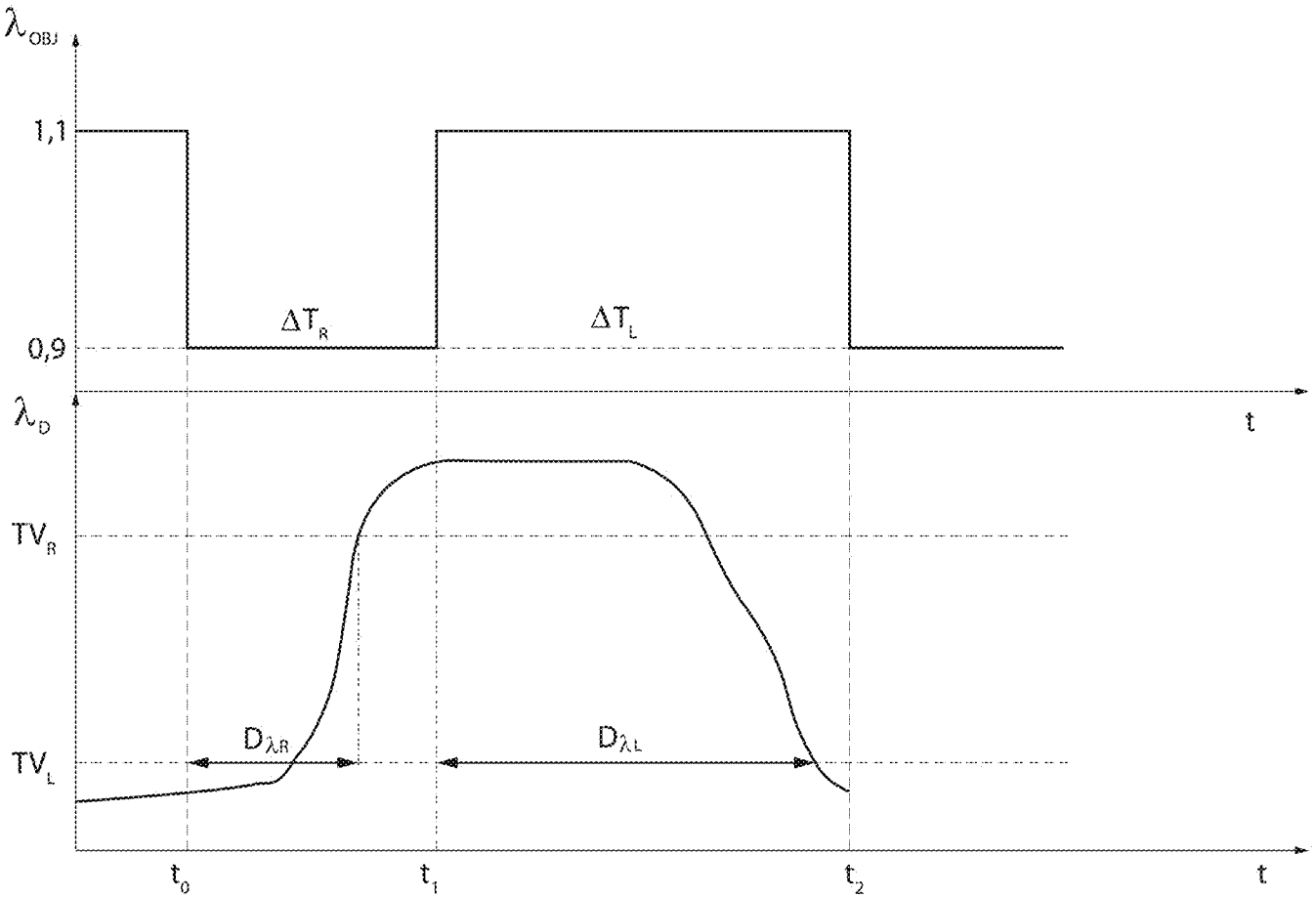
FIG. 3 schematically illustrates the development of an objective lambda value and the development of the lambda value measured by a lambda sensor from FIGS. 1 and 2.

Electronic control unit ECU is then configured to drive air supply circuit 23 to implement an objective air flow rate and fuel supply circuit 29 to implement an objective lambda value $\lambda_{OBJ}$. More in detail, electronic control unit ECU is configured to drive air supply circuit 23 and fuel supply circuit 29 in such a way that objective lambda value $\lambda_{OBJ}$ only implements a step-like development in the event that the diagnosis of precatalyst 15 is requested by calculating oxygen storage capacity OSC. As illustrated in FIG. 3, the development of the objective lambda value $\lambda_{OBJ}$ starts with an objective lambda value $\lambda_{OBJ}$ greater than 1 and when the strategy for calculating the oxygen storage capacity of precatalyst 15 is implemented there is an alternation between at least one time interval $\Delta T_R$ in which the objective lambda value $\lambda_{OBJ}$ is less than 1 and at least one time interval $\Delta T_L$ in which the objective lambda value $\lambda_{OBJ}$ is greater than 1. Preferably, the time intervals $\Delta T_L$, $\Delta T_R$ have variable durations. In more detail, the time intervals $\Delta T_L$, $\Delta T_R$ have a variable duration depending on the mass flow rate through precatalyst 15, the actual lambda value A and the thermal and ageing state of precatalyst 15.

Advantageously, in time interval $\Delta T_R$ (between instants $t_0$ and $t_1$) objective lambda value $\lambda_{OBJ}$ is less than 1; according to a preferred embodiment, objective lambda value $\lambda_{OBJ}$ is equal to 0.9.

Advantageously, in time interval $\Delta T_L$ (between instants $t_1$ and $t_2$) objective lambda value $\lambda_{OBJ}$ is greater than 1; according to a preferred embodiment, objective lambda value $\lambda_{OBJ}$ is equal to 1.1.

Advantageously, electronic control unit ECU is configured to implement a predetermined number of steps (i.e., a predetermined number of times the transition from the objective lambda value $\lambda_{OBJ}$ less than one to the objective lambda value $\lambda_{OBJ}$ greater than one is implemented).

FIG. 3 shows the development of lambda value $\lambda_D$ detected by lambda probe 19 arranged downstream of precatalyst 15; $TV_L$ indicates a threshold value for detecting a lean mixture via lambda probe 19 and $TV_R$ indicates a threshold value for detecting a rich mixture via lambda probe 19.

$D_{\lambda R}$ indicates the delay with which lambda probe 19 detects the change in objective lambda value $\lambda_{OBJ}$ from instant $t_0$. In other words, delay $D_{\lambda R}$ represents the delay with which lambda probe 19 detects the transition from objective lambda value $\lambda_{OBJ}$ greater than 1 to objective lambda value $\lambda_{OBJ}$ less than 1. Alternatively, DL denotes the delay with which lambda probe 19 detects the change in objective lambda value $\lambda_{OBJ}$ from instant $t_1$. In other words, delay $D_{\lambda L}$ represents the delay with which lambda probe 19 detects the transition from objective lambda value $\lambda_{OBJ}$ less than 1 to objective lambda value $\lambda_{OBJ}$ greater than 1. In other words, $D_{\lambda R}$ and $D_{\lambda L}$ represent the delay with which lambda probe 19 reaches threshold value $TV_R$ or threshold value $TV_L$ respectively.

Once $D_{\lambda R}$ and $D_{\lambda L}$ have been determined, electronic control unit ECU is finally configured to calculate the oxygen storage capacity of catalyst 15.

In more detail, oxygen storage capacity OSC is calculated using formula:

$$OSC = M_{AF} * 0.23 * \frac{|1 - \lambda_{AVG}|}{\lambda_{AVG}} * D_\lambda \quad [1]$$

wherein:

$M_{AF}$ represents the mass flow rate of exhaust gases in precatalyst 15;

$\lambda_{AVG}$ average lambda value in range $\Delta T_L$ or $\Delta T_R$;

0.23 percentage (23%) of oxygen in the air; and $D_\lambda$ delay of lambda probe 19.

$D_\lambda$ is equal to $D_{\lambda R}$ for the calculation of oxygen storage capacity OSC during the rich step ($OSC_{RICH}$); while $D_\lambda$ is equal to $D_{\lambda L}$ for the calculation of oxygen storage capacity OSC during the lean step ($OS_{CLEAN}$). According to a first variant, only the oxygen storage capacity value OSC during the lean step ($OS_{CLEAN}$) is used; alternatively, a final oxygen storage capacity OSC value ($OSC_{FINAL}$) calculated as the average oxygen storage capacity value OSC between the oxygen storage capacity OSC during the lean step ($OS_{CLEAN}$) and the oxygen storage capacity OSC during the rich step ($OSC_{RICH}$) is used.

Advantageously, the $M_{AF}$ mass flow rate of exhaust gas flowing through precatalyst 15 can easily be kept stable and uniform (constant) when the measurement of oxygen storage capacity OSC is performed using burner 21.

If the diagnosis of the correct operation of catalyst 15 is carried out several times within one operating cycle, the average oxygen storage capacity value OSC can be determined. For example, the oxygen storage capacity OSC is calculated by averaging oxygen storage capacity OSC calculated in time interval $\Delta T_L$ and in time interval $\Delta T_R$.

The oxygen storage capacity value OSC or average oxygen storage capacity OSC can be advantageously corrected according to the temperature of precatalyst 15.

Alternatively, in the event that the temperature precatalyst 15 is below a threshold value representing the limit below which the calculation of oxygen storage capacity value OSC is unrepresentative, before proceeding with the diagnostic strategy, electronic control unit ECU is configured to heat precatalyst 15 to reach said threshold value.

Subsequently, the oxygen storage capacity value OSC or average oxygen storage capacity value OSC are compared with a minimum oxygen storage capacity value OSC, which defines the threshold below which precatalyst 15 is defined as either faulty or inoperative. If the oxygen storage capacity OSC or the average oxygen storage capacity OSC is greater than or equal to said minimum value, the diagnostic strategy concludes positively; whereas, if the oxygen storage capacity OSC or the average oxygen storage capacity OSC is less than said minimum value, the diagnostic strategy concludes negatively and the ECU unit is configured to signal a malfunction.

In the preceding discussion, explicit reference was made to the processing of the signal from lambda probe 19, but the diagnosis strategy described in the preceding discussion can also be advantageously applied when using the signal from lambda probe 20; in this case, the diagnosis strategy makes it possible to calculate the oxygen storage capacity OSC of precatalyst 15 and catalytic converter 17. The applicant has verified experimentally that the diagnosis strategy using burner 21 described in the preceding discussion has several advantages, in particular over the known strategy using internal combustion engine 1 while providing essentially the same oxygen storage capacity values.

In particular, the diagnosis strategy using burner 21 described in the preceding discussion reduces pollutant emissions compared to the known strategy using internal combustion engine 1; moreover, the calculation of oxygen storage capacity OSC is more accurate and reliable due to the fact that it is carried out under stable conditions (in particular, with precatalyst 15 sufficiently hot and internal combustion engine 1 switched off or at idle speed).

LIST OF REFERENCE NUMBERS

1 internal combustion engine
2 exhaust system
3 cylinders
4 intake manifold
5 exhaust manifold
6 intake duct
7 air filter
8 throttle valve
9 air flow meter
10 exhaust duct
11 turbocharger
12 turbine
13 compressor

14 after-treatment system
15 precatalyst
16 particulate filter
17 catalytic converter
18 linear probe
19 lambda sensor
20 lambda sensor
21 burner
22 combustion chamber
23 air supply circuit
24 pumping device
25 duct
26 shut-off valve
27 injector
28 spark plug
29 fuel supply circuit
30 pumping device
31 duct
33 sensor P, T
34 sensor P, T
35 outlet duct
36 sensor P, T
38 valve
39 fuel tank
ECU electronic control unit
$\lambda_{OBJ}$ objective lambda value
$\lambda_D$ measured lambda value
$D_{\lambda R}$ delay
$D_{\lambda L}$ delay
$\Delta T_L$ time interval
$\Delta T_R$ time interval
$TV_L$ threshold value
$TV_R$ threshold value
$t_1$ instant
$t_2$ instant
$t_0$ instant

The invention claimed is:

1. A method to determine an oxygen storage capacity (OSC) of a catalytic converter of an exhaust gas system of an internal combustion engine; wherein the exhaust gas system comprises:

an exhaust duct, along which the catalytic converter is housed;

a lambda sensor housed along the exhaust duct downstream of the catalytic converter to detect a concentration of oxygen in exhaust gases; and an exhaust gas after-treatment system having a burner that introduces exhaust gases into the exhaust duct, wherein inside the burner there is defined a combustion chamber, which receives fresh air through a first supply circuit and fuel from a second supply circuit;

the method comprises the steps of:

a) determining whether the internal combustion engine is in a stop phase;

b) controlling the first and the second supply circuit to the burner so as to obtain an objective lambda value ($\lambda_{OBJ}$), other than one;

c) determining a delay with which the lambda sensor detects a change in the objective lambda value ($\lambda_{OBJ}$);

d) calculating the oxygen storage capacity (OSC) of the catalytic converter using said delay using formula:

$$OSC = M_{AF} * 0.23 * \frac{|1 - \lambda_{AVG}|}{\lambda_{AVG}} * D_\lambda$$

wherein:

MAF represents the mass flow rate of exhaust gases in a precatalyst;

$\lambda_{AVG}$ is the average lambda value;

0.23 represents (23%) of oxygen in the air; and $D_\lambda$ represents the delay of a lambda probe; and e) controlling the exhaust gas after-treatment system so as to adjust the amount of fresh air in the first supply circuit and the fuel in the second supply circuit so as to achieve the objective lambda value ($\lambda_{OBJ}$) based on the calculated oxygen storage capacity (OSC).

2. The method according to claim 1, wherein the first and second supply circuits are controlled to as to obtain an objective lambda value ($\lambda_{OBJ}$) that is greater than 1.

3. The method according to claim 1, wherein the first and second supply circuits are controlled to as to obtain an objective lambda value ($\lambda_{OBJ}$) that is smaller than 1.

4. The method according to claim 1, wherein the objective lambda value ($\lambda_{OBJ}$) has a step-like development, in which it alternatively is greater than 1 and smaller than 1.

5. The method according to claim 2 wherein the step of calculating the oxygen storage capacity (OSC) of the catalytic converter using said delay further includes the steps of:

determining a delay ($D_{\lambda L}$) of a lean step with which the lambda sensor detects the change in the objective lambda value ($\lambda_{OBJ}$) from smaller than one to greater than one; and calculating the oxygen storage capacity (OSC) of the catalytic converter using said delay ($D_{\lambda L}$) of the lean step.

6. The method according to claim 4 wherein the step of calculating the oxygen storage capacity (OSC) of the catalytic converter using said delay further includes the steps of:

determining a delay ($D_{\lambda L}$) of a lean step with which the lambda sensor detects the change in the objective lambda value ($\lambda_{OBJ}$) from smaller than one to greater than one;

determining a delay ($D_{\lambda R}$) of a rich step with which the lambda sensor detects the change in the objective lambda value ($\lambda_{OBJ}$) from greater than one to smaller than one;

calculating an oxygen storage capacity ($OSC_{LEAN}$) of the lean step by means of said delay ($D_{\lambda L}$) of the lean step;

calculating an oxygen storage capacity ($OSC_{RICH}$) of the rich step by means of said delay ($D_{\lambda R}$) of the rich step; and calculating an average value between the oxygen storage capacity ($OSC_{LEAN}$) of the lean step and the oxygen storage capacity ($OSC_{RICH}$) of the rich step.

7. The method according to claim 1 further including the steps of:

calculating a plurality of values of the oxygen storage capacity (OSC) of the catalytic converter within a same operating cycle; and determining an average value of the oxygen storage capacity (OSC) of the catalytic converter.

8. The method according to claim 1, further including the step of correcting a value of the oxygen storage capacity (OSC) or an average value of the oxygen storage capacity (OSC) based on a temperature of the catalytic converter.

9. The method according to claim 1, wherein prior to the step of controlling the first and the second supply circuit to the burner so as to obtain an objective lambda value ($\lambda_{OBJ}$), heating the catalytic converter so as to reach an operating temperature threshold value.

* * * * *